US006994272B2

(12) United States Patent
Kurrle et al.

(10) Patent No.: US 6,994,272 B2
(45) Date of Patent: Feb. 7, 2006

(54) INJECTOR FOR HIGH-PRESSURE FUEL INJECTION

(75) Inventors: Michael Kurrle, Wendlingen (DE); Reiner Koch, Ludwigsburg (DE); Joerg-Peter Fischer, Deizisau (DE)

(73) Assignee: Robert Bosch GmbH, Stuttgart (DE)

( * ) Notice: Subject to any disclaimer, the term of this patent is extended or adjusted under 35 U.S.C. 154(b) by 237 days.

(21) Appl. No.: 10/466,911

(22) PCT Filed: Oct. 15, 2002

(86) PCT No.: PCT/DE02/03882

§ 371 (c)(1),
(2), (4) Date: Jul. 23, 2003

(87) PCT Pub. No.: WO03/046369

PCT Pub. Date: Jun. 5, 2003

(65) Prior Publication Data

US 2004/0050367 A1 Mar. 18, 2004

(30) Foreign Application Priority Data

Nov. 23, 2001 (DE) ..... 101 57 411

(51) Int. Cl.
*F02M 41/16* (2006.01)

(52) U.S. Cl. ..... 239/96; 239/102.2; 239/533.9; 239/585.1; 123/447; 123/501; 123/506

(58) Field of Classification Search ..... 239/88–92, 239/96, 533.2, 533.3, 533.9, 584, 102.2, 239/585.1; 123/447, 472, 501, 506
See application file for complete search history.

(56) References Cited

U.S. PATENT DOCUMENTS 6,067,955 A * 5/2000 Boecking ..... 123/501
6,269,795 B1 * 8/2001 Ripper et al. ..... 239/533.9
6,575,140 B2 * 6/2003 Boecking ..... 123/506

FOREIGN PATENT DOCUMENTS

DE 199 50 779 A 4/2001

* cited by examiner

*Primary Examiner*—Steven J. Ganey
(74) *Attorney, Agent, or Firm*—Ronald E. Greigg

(57) ABSTRACT

An injector for high-pressure injection of fuel in self-igniting internal combustion engines includes an actuator valve for opening and closing the injector; a nozzle needle, which in the closed state of the injector closes at least one injection opening; a metering valve, which establishes a hydraulic communication between the actuator valve and the relief chamber of the injector; a pressure holding device, which serves to maintain a static pressure required for the metering valve; and a first control quantity line for control quantities that flow via the actuator valve, and a second control quantity line for control quantities that flow via the metering valve. The pressure holding device dynamically separates the control quantities of the metering valve from the control quantities of the actuator valve by means of a hydraulic fluctuation damper.

11 Claims, 3 Drawing Sheets

INJECTOR FOR HIGH-PRESSURE FUEL INJECTION

CROSS-REFERENCE TO RELATED APPLICATIONS

This application is a 35 USC 371 application of PCT/DE 02/03882 filed on Oct. 15, 2002.

BACKGROUND OF THE INVENTION

1. Field of the Invention

The common rail injection system provides high-pressure injection of fuel into direct-injection internal combustion engines. In this reservoir injection system, pressure generation and injection are decoupled from one another both chronologically and in terms of location. A separate high-pressure pump generates the injection pressure in a central high-pressure fuel reservoir. The injection onset and the injection quantity are determined by the instant and duration of the triggering of electrically actuated injectors, which communicate with the high-pressure fuel reservoir via fuel lines.

2. Prior Art

German Patent Disclosure DE 100 01 099 A1 relates to a control valve for an injector of a fuel injection system. The control valve includes a final control element and is actuated by an actuator. By means of the control valve, a hydraulic communication between a fuel return and a control chamber of the injector can be established. When the control valve is opened, fuel flows from the control chamber into the fuel return. As a result, the pressure in the control chamber drops, and the hydraulic force acting on the end face of the nozzle needle decreases. As soon as this hydraulic force is less than the hydraulic force acting in the opening direction, the nozzle needle opens, so that the fuel can flow through the injection ports of the injection nozzle into the combustion chamber. This indirect triggering of the nozzle needle via a hydraulic force booster system is necessary because the great forces required for fast opening of the nozzle needle cannot be generated directly by the control valve.

German Patent Disclosure DE 196 50 865 A1 relates to a magnet valve for controlling an electrically controlled fuel injection valve. The valve needle of the fuel injection valve is urged in the closing direction by pressure prevailing in a control chamber. The magnet valve, to initiate the injection, initiates a relief of the control chamber when the magnet of the magnet valve is excited. The valve needle of the injection valve is then lifted from its seat, under the influence of the high pressure acting upon it in the opening direction.

In the prior art, in addition to the fuel quantity injected into the combustion chamber, a so-called "control quantity" is required for indirectly triggering the valve needle. Upon opening of the magnet valve, a control quantity reaches the low-pressure region of the fuel tank via the magnet valve and a control quantity line. Upon closure of the magnet valve, the control valve switches to a different switching position, in which once again a control quantity occurs. For maintaining a master pressure required for the function of the control valve, a pressure holding valve with an inlet throttle upstream of it is used in a further control quantity line, through which the control quantity flows away from the control valve. Downstream of the pressure holding valve, the control quantities from the magnet valve and from the control valve flow in a common line as a total leakage quantity into the low-pressure region. Accordingly, the pressure holding valve serves not only to maintain the aforementioned master pressure but also to separate the pressure potentials of both control quantities (that of the control valve and that of the magnet valve).

In this prior art injector, however, pressure fluctuations in the control quantity line from the control valve occur upon switching of the control valve; they are propagated as far as the valve needle of the magnet valve, and in the least favorable case they can cause unwanted opening of the magnet valve.

SUMMARY OF THE INVENTION

The embodiment according to the invention has the advantage that pressure fluctuations in the control quantity line are damped, and unwanted opening of the actuator valve from the affects of the pressure fluctuations is prevented. Moreover, the invention makes a compact, space-saving embodiment of the pressure holding valve possible.

These advantages are attained according to the invention by an injector for high-pressure injection of fuel in self-igniting internal combustion engines. The injector includes an actuator valve for opening and closing the injector; a nozzle needle, which in the closed state of the injector closes at least one injection opening; a metering valve, which establishes a hydraulic communication between the actuator valve and the relief chamber of the injector; a pressure holding device, which serves to maintain a static pressure required for the metering valve; and a first control quantity line for control quantities that flow via the actuator valve, and a second control quantity line for control quantities that flow via the metering valve. The pressure holding device dynamically separates the control quantities of the metering valve from the control quantities of the actuator valve and furthermore serves as a hydraulic fluctuation damper.

The pressure holding device is accordingly constructed such that it damps pressure fluctuations of the fuel. In particular, these are pressure fluctuations that occur upon switching of the metering valve in the associated control quantity line.

In a preferred embodiment of the present invention, the actuator valve is a magnet valve. In another variant of the invention, the actuator of the actuator valve is a piezoelectric actuator. An advantage of a piezoelectric actuator is that major adjusting forces and rapid response of the actuator are assured.

BRIEF DESCRIPTION OF THE DRAWINGS

The invention will be described in further detail below in conjunction with the drawings, in which.

DESCRIPTION OF THE PREFERRED EMBODIMENTS

Figure 1:
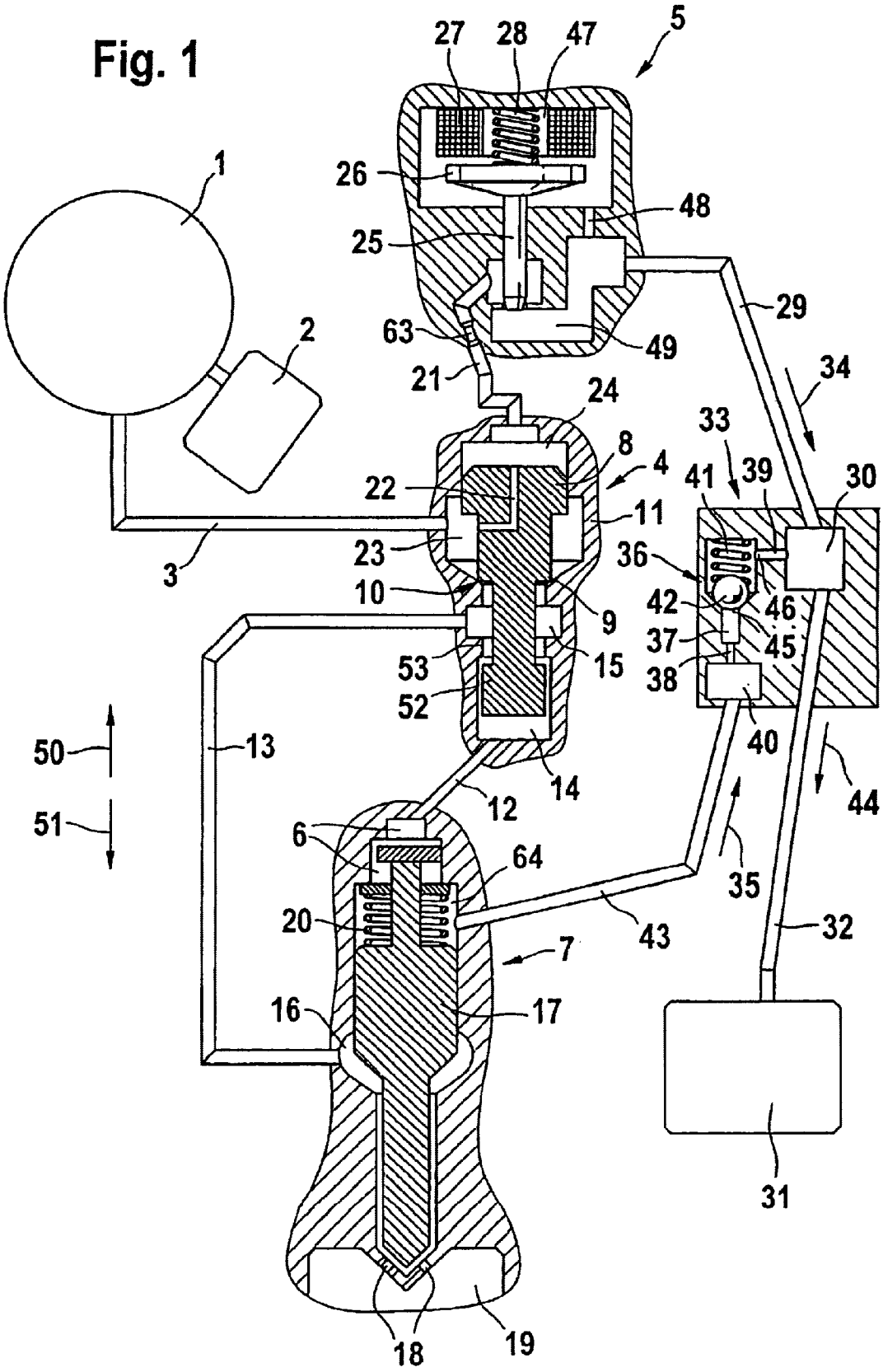
FIG. 1 is a schematic illustration of an injector of the invention, with a magnet valve, metering valve and pressure holding device and a high-pressure fuel reservoir communicating with it.

FIG. 1 schematically shows an injector of the invention, with a magnet valve, a metering valve, and a pressure holding device. A high-pressure fuel reservoir (common rail) communicating with it is also shown.

The system shown is a pressure-controlled common rail injection system. In a high-pressure fuel reservoir 1

(common rail), fuel is stored at high pressure (up to 1400 bar). A high-pressure pump 2 pumps the fuel into the high-pressure fuel reservoir 1. The high-pressure fuel reservoir 1 communicates via a high-pressure line 3 with a metering valve 4. The metering valve 4 establishes a hydraulic communication between a magnet valve 5 and the relief chamber 6 of an injection nozzle 7. The metering valve 4 is a 3/2-way valve. An adjusting piston 8 is disposed displaceably in the interior of the hollow metering valve 4. The adjusting piston 8 has a seat edge 9. In one switching position shown in FIG. 1, the adjusting piston is displaced in the metering valve body 11 such that the seat edge 9 rests on a valve seat 10 embodied in the metering valve body 11. In this switching position of the metering valve 4, the high-pressure line 3 is hydraulically disconnected from the injection nozzle 7. Two lines 12, 13 lead from the metering valve 4 to the injection nozzle 7. The first line 12 connects a partial chamber 14 of the metering valve 4 with the relief chamber 6 of the injection nozzle 7. The second line 13 extends from an annular chamber 15 in the metering valve body 11 to a fuel supply chamber 16, which surrounds the nozzle needle 17 of the injection nozzle 7. As a result, high pressure cannot build up in the fuel supply chamber 16, and so the nozzle needle 17 remains closed.

In the second switching position of the metering valve 4, the adjusting piston 8 in the metering valve body 11 is displaced in the opening direction 50. In this switching position, a partial region 52 of the adjusting piston 8 of larger diameter is sealed off from a partial region 53 of the metering valve body 11, so that the partial chamber 14 of the metering valve 4 is hydraulically disconnected from the annular chamber 15. In this switching position, a communication exists among the high-pressure line 3, the partial chamber 23 of the metering valve 4, the annular chamber 15, the line 13 to the injection nozzle 7, and the fuel supply chamber 16.

In the closed state of the injector, the nozzle needle 17 closes injection openings 18, which discharge into the combustion chamber 19 of the engine. A compression spring 20 generates a closing force on the nozzle needle 17.

The magnet valve 5 and the metering valve 4 communicate with one another via a control line 21. An inlet throttle element 22 extends through the adjusting piston 8 of the metering valve 4 and discharges into two partial chambers 23, 24 in the interior of the metering valve body 11; one partial chamber 23 communicates with the high-pressure line 3, and the other partial chamber 24 communicates with the control line 21, which contains an outlet throttle element 63.

The magnet valve 5 contains a magnet valve needle 25, which can be opened via a magnet armature 26 and an electromagnet 27. A compression spring 28 generates a closing force on the magnet valve needle 25. The spring chamber 47 of the magnet valve 5 is in communication, via a compensation throttle 48, with a container 49 that can be closed toward the control line 21 by the magnet valve needle 25. Via the compensation throttle 48, the pressure in the container 49 that acts in the opening direction 50 upon the magnet valve needle 25 and the pressure in the spring chamber 47 of the magnet valve 5 that generates a net force on the magnet valve needle 25 in the closing direction 51 can be balanced. When there is the same pressure in the container 49 as in the spring chamber 47, the forces on the magnet valve needle 25 in the opening direction 50 and in the closing direction 51 are in equilibrium, since the effective surface areas are the same size. Accordingly, the magnet valve 5 is kept closed solely by the force of the compression spring 28. From the magnet valve 5, a first control quantity line 29 leads into a control quantity container 30, and from there, a total leakage line 32 leads into a low-pressure region 31, which for instance is the fuel tank of the engine.

The control quantity container 30 is part of a pressure holding device 33. The pressure holding device 33 serves on the one hand to maintain a static pressure required for the metering valve 4 and on the other to separate the control quantities 34 of the magnet valve 5 and the control quantities 35 of the metering valve 4 dynamically. The separation is dynamic, since the control quantities 35 of the metering valve 4 fluctuate and thus are highly dynamic, while the control quantities 34 of the magnet valve 5 are quasi-stationary, since the container 49 acts to inhibit fluctuation. The two control quantities 34, 35 do not influence one another dynamically. The pressure holding device 33 in the present invention furthermore has the function of a hydraulic fluctuation damper. In addition to the control quantity container 30, it contains a pressure holding valve 36, a volume reservoir 37, an inlet throttle 38, an outlet throttle 39, and an inflow container 40. The pressure holding valve 36 in this preferred embodiment of the present invention is a spring-loaded valve, in particular a spring-loaded ball valve, which includes a compression spring 41 and a ball 42. The control quantities 35 of the metering valve 4 reach the pressure holding device 33, via the first line 12, the relief chamber 6 of the injection nozzle 7, the spring chamber 64, and a second control quantity line 43. When the pressure holding valve 36 is open, the control quantities 35 of the metering valve 4 flow through the second control quantity line 43 into the inflow container 40. From there, via the inlet throttle 38, the volume reservoir 37, the pressure holding valve 36, and the outlet throttle 39, they reach the control quantity container 30.

In the preferred embodiment of the present invention shown in FIG. 1, the pressure holding device 33 includes an inlet throttle 38, which is disposed between the second control quantity line 43 and the pressure holding valve 36. The pressure holding device 33 furthermore preferably includes an outlet throttle 39, which is disposed at the outlet 46 from the pressure holding valve 36. Finally, the pressure holding device 33, in the preferred embodiment shown of the present invention, includes a volume reservoir 37, which is disposed between the inlet throttle 38 and the inlet 45 to the pressure holding valve 36.

In the control quantity container 30, the control quantities 35 of the metering valve 4 and the control quantities 34 of the magnet valve 5 mix with one another and are carried as a total leakage quantity 44 into the low-pressure region 31 via the total leakage line 32.

An injection event proceeds as follows:

First, the magnet valve 5 is closed. As a result, the control line 21 is closed toward the container 49. The metering valve 4 is in the first switching position; that is, the adjusting piston 8 is displaced in the closing direction 51 in the metering valve body 11, so that the seat edge 9 rests on the valve seat 10. The first partial chamber 23 of the metering valve 4 is accordingly sealed off from the annular chamber 15. In this switching position of the metering valve 4, the high-pressure fuel is located in the first partial chamber 23, and from there, via the inlet throttle element 22, is available in both the second partial chamber 24 and the control line 21. In the second partial chamber 24, this fuel generates a force in the closing direction 51, which acts on the adjusting piston 8 and as a result presses the seat edge 9 of the adjusting piston 8 onto the valve seat 10. In the annular chamber 15, in the partial chamber 14, in the first and second lines 12, 13, in the fuel supply chamber 16, and in the relief chamber 6 of the injection nozzle 7, a uniform pressure prevails that is reduced compared to the high pressure. The nozzle needle 17, predominantly because of the spring force of the compression spring 20, closes off the injection openings 18 from the combustion chamber 19. In this switching position, the pressure holding valve 36 is closed, and neither control quantities 34 of the magnet valve 5 nor control quantities 35 of the metering valve 4 flow. A static pressure is created from the partial chamber 14 of the metering valve as far as the inflow container 40.

By the actuation of the magnet valve 5 (excitation of the electromagnet 27), the magnet armature 26 is moved in the opening direction 50, until it contacts the electromagnet 27. The magnet valve needle 25 opens, and via the container 49 in the first control quantity line 29, the fuel flows out of the second partial chamber 24 of the metering valve 4 and out of the control line 21. Consequently, the force in the opening direction 50 on the adjusting piston 8 is greater, because of the pressure difference between the second partial chamber 24 and the first partial chamber 23, than the force in the closing direction 51, and so the adjusting piston 8 moves into the second switching position. The partial region 52 of the adjusting piston 8, with its larger diameter, reaches the partial region 53 of the metering valve body 11 and thus interrupts the hydraulic communication between the annular chamber 15 and the partial chamber 14. The first partial chamber 23, in this switching position, is conversely opened toward the annular chamber 15, so that fuel at high pressure from the high-pressure line 3 reaches the fuel supply chamber 16, via the first partial chamber 23, the annular chamber 15, and the second line 13. The high pressure in the fuel supply chamber 16 generates a force in the opening direction 50 on the nozzle needle 17 that is greater than the force of the compression spring 20 and than the lesser pressure in the relief chamber 6 in the closing direction 51. Consequently, the nozzle needle 17 opens, and fuel is injected at high pressure into the combustion chamber 19 via the injection openings 18. In this second switching position, a control quantity 34 flows uninterruptedly via the inlet throttle element 22, the outlet throttle element 63, the control line 21, the container 49, and the first control quantity line 29, into the control quantity container 30, and from there into the low-pressure region 31 via the total leakage line 32. The pressure holding valve 36 is closed, and no control quantities 35 of the metering valve 4 flow via the second control quantity line 43.

For terminating the injection event, the magnet valve 5 closes as a result of shutoff of the electromagnet 27 and as a result of the force of the compression spring 28. The pressure in the second partial chamber 24 of the metering valve 4 rises again, and as a result the adjusting piston 8 is moved into the first switching position shown in FIG. 1. As a result of this switching motion, a control quantity 35 flows into the partial chamber 14 of the metering valve 4. This abruptly-moved control quantity 35 causes hydraulic fluctuations in the line 12, in the relief chamber 6, in the second control quantity line 43, and in the inflow container 40. Via the inlet throttle 38, a pressure reduction in the control quantity 35 is effected, and via the volume reservoir 37, damping of the hydraulic fluctuations is effected. The pressure holding valve 36 opens as soon as the static pressure, which is set by the design of the pressure holding valve 36, is exceeded, and consequently the control quantity 35 flows via the outlet throttle 39 into the control quantity container 30, and from there into the low-pressure region 31. The pressure in the control quantity container 30 as a result of the control quantity 35 also acts, via the first control quantity line 29, on the magnet valve needle 25 in the opening direction 50. The inlet throttle and outlet throttle 38, 39 and the volume reservoir 37 are dimensioned in the present invention, in terms of their diameter and volume, respectively, such that the pressure in the control quantity container 30 does not exceed a maximum pressure, for instance of 5 bar. What is attained in particular as a result is that the pressure in the spring chamber 47 of the magnet valve remains limited to this maximum pressure, because of the tightness of the coil of the electromagnet 27. Moreover, by a suitable choice of the diameter of the inlet throttle 38 and the outlet throttle 39, it is assured that pressure fluctuations in the second control quantity line 43 have no effect on the actuator valve, and in particular on the motion of the actuator valve needle. The compensation throttle 48 prevents hydraulic fluctuations or surges in the first control quantity line 29 from being transmitted to the magnet armature 26.

The preferred embodiment of the present invention, shown in FIG. 1, advantageously offers, in addition to the advantage that it prevents unwanted opening of the magnet valve 5, the possibility as well of keeping the pressure holding valve 36 very small, because of the disposition of the throttles 38, 39 and of the volume reservoir 37. The high-pressure injection system shown schematically in FIG. 1 can be a so-called PCS (for pressure controlled common rail system), in which the metering valve 4 is integrated with the injector. However, it can also be a DCRS (pressure-controlled common rail system), in which the metering valve 4 is a module that is isolated from the injector.

Figure 2:
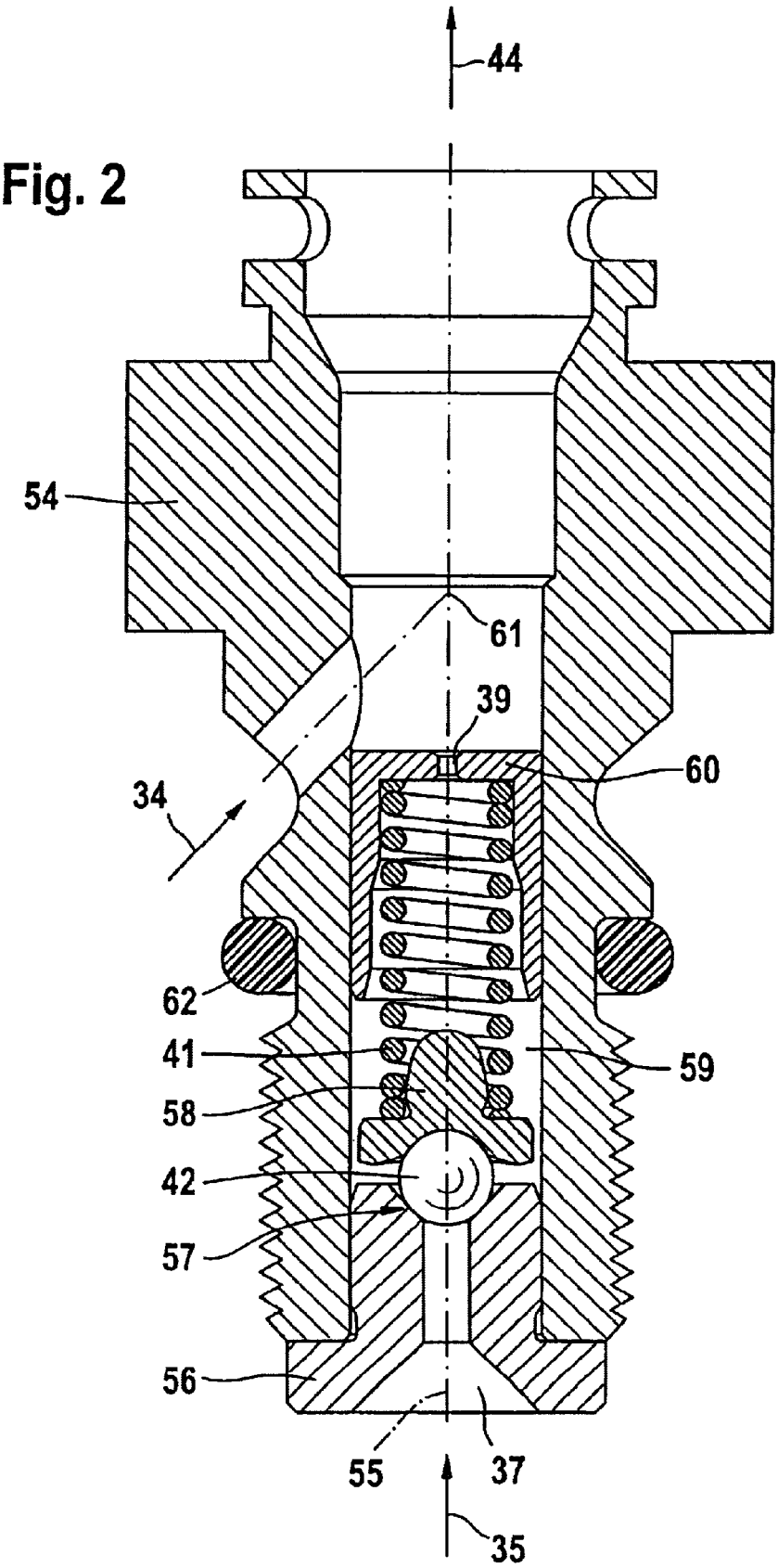
FIG. 2, a detail of a pressure holding device of the present invention.

FIG. 2 shows a detail of a pressure holding device according to the present invention.

A pressure holding valve body 54 is shown, in which the ball 42 and the compression spring 41 of a spring-loaded ball valve are disposed along its longitudinal axis 55. In the closed state of the valve, the ball 42 is pressed against a valve ball seat 57 contained in the transition element 56. A ball holder 58 serves to connect the ball 42 with the compression spring 41. The volume reservoir 37 is shown in only fragmentary form. A sealing ring 62 seals off the pressure holding device in the installed state. The control quantities 35 of the metering valve 4 (not shown) reach the outlet throttle 39 via the volume reservoir 37, when the ball valve is open into the spring chamber 59. The outlet throttle 39 is located in a prestressing device 60, which defines the spring chamber 59 and simultaneously keeps the compression spring 41 prestressed. Once the control quantity 35 of the metering valve 4 has passed through the outlet throttle 39, it converges with the control quantity 34 of the magnet valve 5 (not shown) at point 61, and all the control quantities are carried in the form of a total leakage quantity 44 into a low-pressure region.

Figure 3:
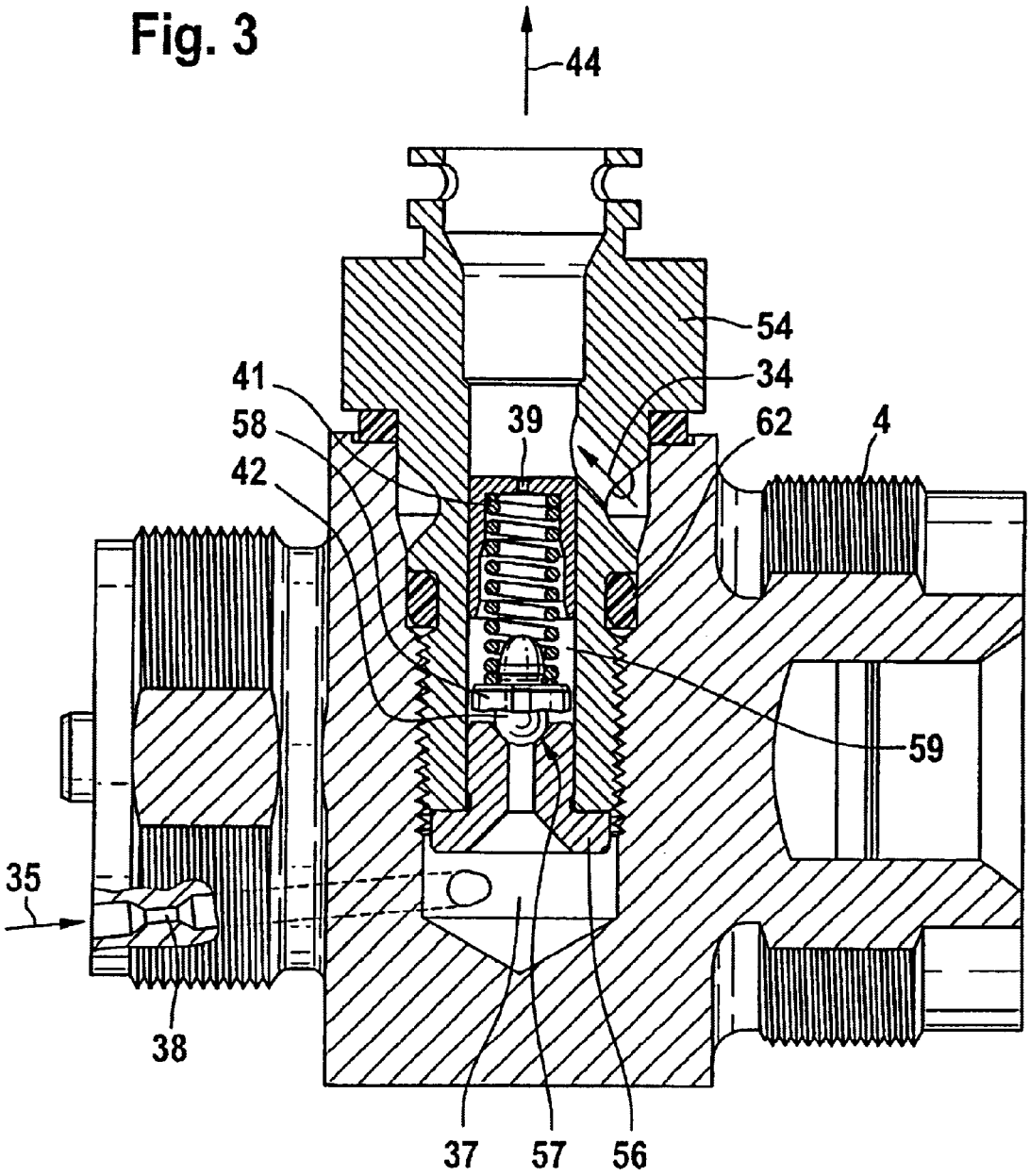
FIG. 3, a pressure holding device of the present invention.

FIG. 3 shows a pressure holding device in accordance with the present invention.

It includes, as already described in conjunction with FIG. 2, the volume reservoir 37, the transition element 56, the ball 42, the ball holder 58, the compression spring 41 in the spring chamber 59, the sealing ring 62, and the outlet throttle 39. In addition, the metering valve 4 is mounted (although shown only in fragmentary form) on the pressure holding valve body 54. Via the inlet throttle 38, the control quantities 35 of the metering valve 4 reach the volume reservoir 37. Downstream of the outlet throttle 39, these control quantities 35 converge with the control quantities 34 of the magnet valve 5 (not shown) to form a total leakage quantity 44.

The foregoing relates to preferred exemplary embodiment of the invention, it being understood that other variants and embodiments thereof are possible within the spirit and scope of the invention, the latter being defined by the appended claims.

LIST OF REFERENCE NUMERALS

1 High-pressure fuel reservoir
2 High-pressure pump
3 High-pressure line
4 Metering valve
5 Magnet valve
6 Relief chamber of the injection nozzle
7 Injection nozzle
8 Adjusting piston of the metering valve
9 Seat edge
10 Valve seat
11 Metering valve body
12 First line between metering valve and injection nozzle
13 Second line between metering valve and injection nozzle
14 Partial chamber of the metering valve
15 Annular chamber
16 Fuel supply chamber
17 Nozzle needle
18 Injection openings
19 Combustion chamber
20 Compression spring
21 Control line
22 Inlet throttle element
23 First partial chamber of the metering valve
24 Second partial chamber of the metering valve
25 Magnet valve needle
26 Magnet armature
27 Electromagnet
28 Compression spring
29 First control quantity line
30 Control quantity container
31 Low-pressure region
32 Total leakage line
33 Pressure holding device
34 Control quantities of the magnet valve
35 Control quantities of the metering valve
36 Pressure holding valve
37 Volume reservoir
38 Inlet throttle
39 Outlet throttle
40 Inflow container
41 Compression spring
42 Ball
43 Second control quantity line
44 Total leakage quantity
45 Inlet to the pressure holding valve
46 Outlet from the pressure holding valve
47 Spring chamber of the magnet valve
48 Compensation throttle
49 Container
50 Opening direction
51 Closing direction
52 Partial region of the adjusting piston
53 Partial region of the metering valve body
54 Pressure holding valve body
55 Longitudinal axis
56 Transition element
57 Valve ball seat
58 Ball holder
59 Spring chamber
60 Prestressing device
61 Convergence point
62 Sealing ring
63 Outlet throttle element
64 Spring chamber

What is claimed is:

1. In an injector for high-pressure injection of fuel in self-igniting internal combustion engines, comprising an actuator valve for opening and closing the injector, a nozzle needle (17), which in the closed state of the injector closes at least one injection opening (18), a metering valve (4), which establishes a hydraulic communication between the actuator valve and a relief chamber (6) of the injector, a pressure holding device (33), which serves to maintain a static pressure required for the metering valve (4), and a first control quantity line (29) for control quantities (34) which flow via the actuator valve, and a second control quantity line (43) for control quantities (35) that flow via the metering valve (4), the improvement wherein that the pressure holding device (33) dynamically separates the control quantities (35) of the metering valve (4) from the control quantities (34) of the actuator valve and acts as a hydraulic fluctuation damper.

2. The injector of claim 1, wherein the actuator valve is a magnet valve (5) having a magnet valve needle (25), or is a piezoelectric actuator valve.

3. The injector of claim 1, wherein the pressure holding device damps pressure fluctuations in the second control quantity line (43) caused by the switching of the metering valve (4).

4. The injector of claim 1, wherein the control quantities (35) of the metering valve (4) and the control quantities (34) of the actuator valve, downstream of the pressure holding device (33), are carried jointly via a total leakage line (32) into a low-pressure region (31).

5. The injector of claim 1, wherein the pressure holding device (33) comprises a pressure holding valve (36).

6. The injector of claim 5, wherein the pressure holding valve (36) is a spring-loaded valve.

7. The injector of claim 5, wherein the pressure holding device (33) includes an inlet throttle (38), which is disposed between the second control quantity line (43) and the pressure holding valve (36).

8. The injector of claim 5, wherein the pressure holding device (33) comprises an outlet throttle (39), which is disposed at the outlet (46) from the pressure holding valve (36).

9. The injector of claim 7, wherein the pressure holding device (33) comprises an outlet throttle (39), which is disposed at the outlet (46) from the pressure holding valve (36).

10. The injector of claim 5, wherein the pressure holding device (33) comprises a volume reservoir (37) disposed between the inlet throttle (38) and the inlet (45) to the pressure holding valve (36).

11. The injector of claim 9, wherein the inlet throttle (38) and the outlet throttle (39) have diameters which assure that pressure fluctuations in the second control quantity line (43) have no effect on the actuator valve.

* * * * *